United States Patent [19]

Prentiss

[11] 4,270,912

[45] Jun. 2, 1981

[54] STABILIZED TANNING COMPOSITION COMPRISING A REACTION PRODUCT OF (A) POLYALDEHYDE (B) SECONDARY AMINE AND (C) AN ALCOHOL AND METHOD

[75] Inventor: William C. Prentiss, New Britain, Pa.

[73] Assignee: Seton Company, Newark, N.J.

[21] Appl. No.: 52,217

[22] Filed: Jun. 26, 1979

[51] Int. Cl.[3] ..... C14C 3/06; C14C 3/16; C14C 3/18

[52] U.S. Cl. ..... 8/94.26; 8/94.19 R; 8/94.27; 8/94.33; 252/8.57; 564/504; 564/506

[58] Field of Search ..... 8/94.26, 94.27, 94.33; 252/8.57; 260/584 R, 584 B, 584 C

[56] References Cited

U.S. PATENT DOCUMENTS

| | | | |
|---|---|---|---|
| 2,847,396 | 8/1958 | Sellet | 8/94.27 |
| 2,851,329 | 9/1958 | Seligsberger | 8/94.26 |
| 3,812,246 | 5/1974 | Vanlerberghe et al. | 8/94.26 |
| 3,888,625 | 6/1975 | Dawson | 8/94.26 |
| 3,909,193 | 9/1975 | Erdmann et al. | 8/94.26 |
| 4,042,321 | 8/1977 | Bacher et al. | 8/94.27 |
| 4,060,384 | 11/1977 | Sieger | 8/94.27 |
| 4,126,413 | 11/1978 | Traubel et al. | 8/94.27 |

*Primary Examiner*—Joseph L. Schofer
*Assistant Examiner*—Herbert J. Lilling
*Attorney, Agent, or Firm*—Webb, Burden, Robinson & Webb

[57] ABSTRACT

A leather tanning composition is comprised of the reaction product of a polyaldehydic compound, a secondary amine and a monohydric alcohol.

43 Claims, No Drawings

STABILIZED TANNING COMPOSITION COMPRISING A REACTION PRODUCT OF (A) POLYALDEHYDE (B) SECONDARY AMINE AND (C) AN ALCOHOL AND METHOD

BACKGROUND OF THE INVENTION

1. Field of the Invention

This invention relates to a tanning composition and tanning method and more particularly to a pretanning composition which is useful in increasing the shrinkage temperature of a hide.

2. Description of the Prior Art

The tanning of hides to prepare leather has been known for many years. The tanning involves a tanning agent which reacts with the hide to prevent putrefaction and degradation thereof.

Over the years it has been found that for nearly all leathers, chrome is a preferred tanning agent. The wastes from chrome tanning processes, however, contain pollutants particularly chrome which is undesirable for enviromental reasons. These pollutants are introduced during the disposal of shavings and leachings from dumped shavings and in the disposal of chrome tanning liquors.

As is described in U.S. Pat. No. 4,060,384, incorporated herein by reference, the amount of chromium used in chrome tanning can be reduced by various techniques such as conducting a pretanning operation with tanning agents that are essentially free of chromium.

Glutaraldehyde has been suggested for pretanning hides that are subsequently chrome tanned, but is considered to lower the tensile and tear strengths of the final leather. Further, the reaction product of the glutaraldehyde with the functional groups, particularly amino groups, of the protein constituents of the leather produce chromophores which impart an undesirable color to the final leather product. Further, the odor of glutaraldehyde is objectionable. An example of such glutaraldehyde tanning is reported in the paper entitled "Oxazolidines—A new Class of Tanning Agent", by S. Dasgupta, published in the Journal of the Society of Leather Technologists and Chemists, Vol. 61, pp. 97-105 (1977). The reductions in tensile are experienced even though the chrome content of the finished leather is higher than for a straight chrome tanning.

Further examples of more efficient chrome tanning are shown in U.S. Pat. No. 3,888,625 wherein sulfide salts are used in conjunction with an aldehyde such as formaldehyde, glutaraldehyde or benzaldehyde.

U.S. Pat. No. 4,060,384 suggests pretanning with mixtures containing glutaraldehyde and other aldehydes, however, the compounds of the present invention are more effective than those disclosed in U.S. Pat. No. 4,060,384.

A pretanning composition which is effective in increasing the shrinkage temperature of a hide along with a decrease in the amount of chrome required for tanning is disclosed in U.S. patent application Ser. No. 052,149 of Marcel Siegler filed the same day as this application. Said U.S. patent application is incorporated herein by reference. Said patent application discloses the reaction product of a polyaldehydic compound and a secondary amine to form a pretanning composition. The resulting reaction product is believed to be represented by the structural formula:

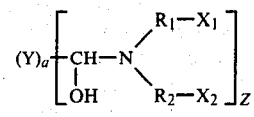

wherein Y is a polyvalent hydrocarbon residue; $R_1$ and $R_2$ are alkylene and may be the same or different and $X_1$ and $X_2$ are hydrogen or OH and may be the same or different; "a" is 0 or 1; and Z is greater than 1.

The compounds according to the said patent application are somewhat unstable and on aging tend to alter in structure and precipitate from aqueous solution. The mechanism which imparts this instability is believed to be attributable to the hydroxyl group which is $\alpha$ to the amino nitrogen. These $\alpha$ hydroxyl groups may condense and hence polymerize to form acetyl type polycondensates.

In accordance with the present invention the pretanning composition disclosed in U.S. patent application Ser. No. 052,149 of Marcel Siegler filed the same date as this application is stabilized.

BRIEF DESCRIPTION OF THE INVENTION

A leather tanning composition comprises the reaction product of a polyaldehydic compound, a secondary amine and a monohydric alcohol.

DETAILED DESCRIPTION OF THE INVENTION

"Hide" as used herein means and refers to skins such as goat, sheep, deer, pig, reptile and the like, and hides such as bovine, buffalo, marsupial and the like. The polyaldehydic compounds of the present invention are those nonpolymeric aldehydes having greater than one aldehyde group and those capable of generating more than one aldehyde group during reaction. Typical useful and commonly available aldehydes are glyoxal and glutaraldehyde. Preferably, the polyaldehydic compounds are those which are substantially water soluble or water solubilizable and produce a water soluble or water solubilizable product. Further, polyaldehydic compounds useful in the practice of the invention may be represented by the structural formula:

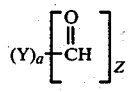

wherein Y is a polyvalent hydrocarbon residue and "a" is 0 to 1 and Z is greater than 1. Most preferably: "a" is 0 or 1, Y is a straight chain alkylene radical, and Z is 2.

The secondary amines useful in the practice of the invention may be represented by the structural formula:

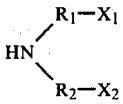

wherein $R_1$ and $R_2$ are alkylene and may be the same or different and $X_1$ and $X_2$ are hydrogen or OH and may be the same or different. Moreover, $R_1$ and $R_2$ may be covalently bonded to form cyclic or heterocyclic secondary amine. Secondary amines useful in the practice of the invention are the dialkyl amines such as diethyl amine, dimethyl amine, diisopropyl amine, dibutyl amine and other lower alkyl amines. Further, and more preferred are the dialkanol amines such as diethanol amine, diisopropanol amine and the like. Further, mono-alkanol alkyl amines may be used such as methyl ethanol amine, ethyl isopropanol amine and the like. Most preferably, the secondary mono-amines useful in the practice of the invention are water soluble and provide a water soluble or water solubilizable reaction product with the polyaldehydic compound. Heterocyclic secondary amines useful in the practice of the invention are those such as pyrrolidine, piperdine, triazoles, phenothiazine, indole, phenoxazine and the like. This water solubility or solubilization is desired in order to provide a homogeneous aqueous solution for treating the hide to form the leather.

Further preferred are the dialkanol amines sterically arranged with the hydroxyl functional groups tending to form complexes with the chrome. Thus, when the hide is pretanned the functional groups of the alkyl moieties of the secondary amine tend to complex with the chrome and improve the chrome take-up of the pretanned hide. Thus, although hydroxyl groups on the alkyl moieties of the amine are preferred, other complex forming functional groups pendant on the alkyl groups of the secondary amine may be used provided they have a tendency to form complexes with chrome. Thus, diethanol amine, because of its chrome complexation properties, is preferred as the secondary amine to be reacted with the polyaldehydic compound.

The alcohols useful in the practice of the invention are those capable of condensation with hydroxyl groups $\alpha$ to an amino nitrogen. These alcohols are well known to those skilled in the art and include monohydric alcohols. Preferably, the monohydric alcohols are the lower alcohols having 1 to 8 carbon atoms and more preferably 1 to 4 and include methanol, ethanol, propanol, butanol and isomers thereof where they exist and mixtures thereof. Further, the monohydric alcohols are sufficiently volatile at processing temperatures so that they may be expelled and are preferably substantially soluble in the reaction medium.

It is believed that the secondary amine reacts with the polyaldehydic compound to form a hemi-acetyl type structure which can be represented by the structural formula:

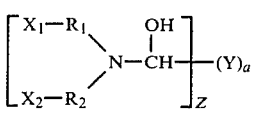

wherein Z is greater than 1, Y is a polyvalent hydrocarbon residue, $R_1$ and $R_2$ are alkylene and may be the same or different, and $X_1$ and $X_2$ are hydrogen or OH and may be the same or different and "a" is equal to 0 or 1. Further, as an equivalent to X equaling OH, X may equal some other group which is capable of complexing with chrome. It is to be noted that in the case where the polyaldehydic compound is glyoxal "a"=0 and Z=2.

It is believed that when the monohydric alcohol is reacted with the secondary amine/polyaldehydic compound reaction product, the hydroxyl $\alpha$ to the amino group is etherified to form a compound represented by the structural formula:

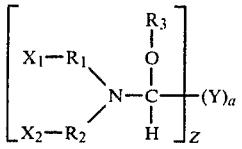

wherein $R_3$ is preferably alkyl and a minor amount of $R_3$ may be hydrogen. A sufficient quantity of $R_3$ equalling alkyl must be present in order to provide the requisite stabilization.

As is previously described preferably Y has 4 carbon atoms and $R_1$ and $R_2$ have previously 2 to 4 carbon atoms and $X_1$ and $X_2$ are preferably OH. Within the scope of the preferred embodiment, the reaction product of glutaraldehyde, diethanol amine and preferably isopropanol, falls within the scope of the above structural formula and such reaction product can be represented by the structural formula:

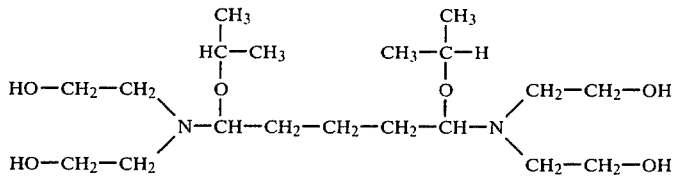

As is understood and believed the etherified hydroxyl group $\alpha$ to the amino nitrogen in the reaction product of the invention is highly reactive particularly with primary amines. As is well known hides are composed of polyamino acids which polyamino acids include side chains having primary amine groups. These primary amine groups readily react with the etherified hydroxyl group $\alpha$ to the amino nitrogen of the compound of the invention. Such reaction can be generally shown by the reaction equation as follows:

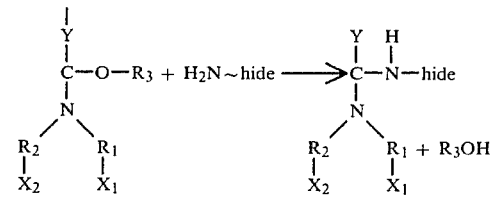

As is shown in the above reaction sequence, the etherified hydroxyl $\alpha$ to the amino nitrogen reacts with the pendant amino group in the hide releasing the alcohol. Preferably, $X_2$ and $X_1$ are hydroxyl or are groups capable of complexation with chrome thus providing a pretanned hide which readily takes up chrome in the final tanning process and effectively increases the shrink temperature thereof to allow for rapid processing of the hide.

The tanning compositions in accordance with the invention can be prepared in aqueous solution in an acid media. The pH of the reaction admixture should be on the acid side and is to be maintained, for example, at 4 to 6 and preferably about 5 to 6.

The equivalent ratio of polyaldehydic compound to secondary mono-amine is preferably 1 to 1; however, excess polyaldehyde or excess amine may be used. Likewise, the molar ratio of 1:1 alcohol to amine is preferred; however, more or less alcohol may be used depending upon the alcohol's solubility in the reaction medium.

The reaction admixture is normally aqueous and contains water at about 10 to 80 percent by weight and preferably at about 40 to 70 percent by weight.

The reaction between the amine and polyaldehyde takes place at ambient temperature (i.e. 20° to 30° C.) and occurs almost instantaneously with the mixture of the reactants. The reaction temperature may be varied in accordance with the chemical and physical properties of the reactants.

The pH adjustment can be made by adding a low molecular weight organic or inorganic acid. The selection of the acid is dependent on its lack of adverse effect on the tanning process. Typical acids useful in the reaction are formic, acetic, lactic and the like and hydrochloric, sulfuric and the like. Acetic acid has been found to be effective because of its buffer characteristics.

It is desirable to select reactants which are water soluble to thus obtain a water soluble product.

The polyaldehydic compound secondary amine reaction product is used in tanning hides alone or in combination with other materials to form leather.

"Tanning" as used herein means and refers to the process of forming leather from hides and includes any stage of processing the hides.

The tanning of the present invention is normally effected on cattle hides or the like after unhairing and bating, and these steps along with the associated washings and the like can be carried out on a charge of hides in a single container, without requiring the removal of a hide from the container until the pretanning is completed. The hides can also be pickled before tanning, while the hides are in the container, and such pickling with the tanning places the hides in condition for shipment to remote geographic locations requiring many weeks en route, without danger of material deterioration. Hides pickled and tanned are preferably wrapped in waterproof plastic sheeting for such shipment to keep them from drying out.

Splitting of the tanned pickled hides is also effected more uniformly and both the grains as well as the splits so made are much closer to the desired weights.

The invention contemplates the use of the compounds of the invention as the sole tanning agent and also in combination with other materials.

Inasmuch as the marketing features of grain leather are quite different from those for split leather, the grain and split intermediates of the present invention are preferably given different final tannings, and these final tannings can be performed in different parts of the world. Where both of these intermediates are subsequently chrome-tanned they can both be shaved before chrome-tanning and before shipping to improve the disposability of the shavings from both intermediates.

When making the heavier leathers, such as those weighing more than 4 ounces, shaving can be minimized or completely eliminated inasmuch as many heavy leathers have a wide caliper tolerance.

The chrome-tanned leather products produced by the foregoing technique have a particularly high slot tear so that they are very desirable for uses where they are subject to tearing influences. In addition to this highly advantageous feature the leather products of the present invention have somewhat better tensile strength, a better break, and fuller flanks as compared with prior art chrome-tanned leathers.

The improved physical characteristics appear to be contributed by the combination of the divided tanning sequence with the splitting and shaving. The splitting and shaving operations are fairly severe mechanical treatments, and carrying them out after a pretanning reduces the severity of their mechanical effects on the hide fibers. Also the final chrome-tanning is carried out on a substrate which is relatively thin and which has been stretched as a result of the splitting and shaving, so that the chrome-tanning is more effective. Indeed there is generally no great need for repeating the chrome-tanning, so that the expense of a second chrome-tanning so often used in the prior art, is reduced.

The relatively small amount of chrome-tanning needed pursuant to the present invention is accentuated by the fact that the chrome-tanning chemicals are used only on a shaved substrate, so that the total amount of these chemicals is further reduced in proportion to the weight of the shavings. The recycle and reuse of the chrome-tanning chemicals is also diminished. The reduction in chrome-tanning chemicals required reduces the cost of the production of leather and the disposal of spent chrome-tanning liquors.

The stretching action referred to above also increases the quantity of leather produced from a hide, when the leather quantity is measured by its surface area. This increase is 2 percent or more depending on the type of leather being made.

The individual steps of the process of the present invention can be carried out in the same way those steps are conventionally conducted in the prior art. However, the shaving step in the process of the present invention requires extra care if it is conducted on pretanned hides that have not been pickled. Hide shaving equipment generally has an adjustable automatic feeding system that controls the speed with which the hide is moved past a rapidly rotating set of spiral knife edges, and the feeding system is adjusted to a feed of 45 or fewer feet per minute, for best shaving of unpickled grains or splits pursuant to the present invention. At higher feed speeds there is a tendency for a pretanned unpickled grain or split to be pulled by the spiral knife edges and improperly shaved, particularly those grains or splits less than about 60 mils thick.

Pretanned pickled grains and splits in accordance with the present invention are, however, very effectively shaved at any desired feed speed, even 55 or more feet per minute, without problems and regardless of caliper. Fat-liquoring the grains and splits to a pick-up of about ¼ to about ¾ percent fat-liquor oil during or after pretanning and before shaving, also helps the shaving. The shaving is further facilitated by the use of mineral tanning agents such as alum, chrome and the like.

The following preferred embodiments are illustrative of the tanning composition and process of the present invention.

EXAMPLE I

To a suitable reaction vessel at ambient temperature is charged 105 pounds of diethanol amine. One hundred and eighty pounds of water is added with agitation to the diethanol amine and mixed until homogeneous. Sixty pounds of acetic acid is slowly charged to the diethanol amine/water solution for acid-base neutralization and to adjust the pH of the diethanol amine/water solution to the desired level. A slight exotherm is experienced upon the addition of the acetic acid. The diethanol water/acetic acid solution is mixed until homogeneous. One hundred pounds of a 50 percent glutaraldehyde solution is charged to the diethanol amine/-water/acetic acid solution with agitation and mixed until homogeneous. Sixty pounds of isopropanol is added and mixed until homogeneous. The reaction mixture is held for 15 minutes. The reaction product solution is filtered and is now ready for use. The reaction product is 35 percent active ingredient (i.e. the reaction product of glutaraldehyde, diethanol amine and isopropanol) and is a clear aqueous solution of pale yellow color. The pH is 5.5 to 5.7.

EXAMPLE II

The percentages of reagents in this example are based upon the limed weight of the hides except where indicated otherwise.

About 600 pounds of salt-cured fleshed heavy native steer hides that have been dehaired and limed are weighed and loaded in a 16 RPM processing drum half filled with tap water at 80° to 90° F. (27° to 32° C.).

The following operations are then carried out:

(a) The drum is rotated for 5 minutes, stopped, drained, refilled half-way with 90° F. (32° C.) tap water, and again operated for 5 minutes.

(b) The drum is drained, fresh 90° F. (32° C.) tap water added to a medium float, ½ percent ammonium sulfate added and the drum is rotated 5 minutes followed by a 10 minute rest and draining of the drum.

(c) Fresh 90° F. (32° C.) tap water is again added to half-fill the drum, it is rotated 5 minutes, stopped for 5 minutes, and again rotated for 5 minutes.

(d) The drum is again stopped, drained to about 30% float with 90° F. (32° C.) tap water, 2½ percent ammonium chloride is then added along with 0.07 percent of a bating agent. The drum is then operated for 10 minutes, rested for 15 minutes, run again 10 minutes and again rested for 15 minutes.

(e) There is now added 0.1 percent p-octylphenoxy decaethoxy ethanol wetting agent and ¼ percent sodium bisulfite; the wetting agent being first dissolved in 5 times its weight of water, and the sodium bisulfite first dissolved in 10 times its weight of water. The drum is now operated for 15 minutes and then rested for 15 minutes.

(f) ¼ percent formic acid is now added to the drum, this acid being first diluted with 10 times its weight of water. The drum is then run for 15 minutes and rested for 15 minutes, after which the hides are inspected and the bating liquor checked. A liquor temperature below 85° F. (30° C.), a pH above 7.5, or a hide texture inadequately opened by the bating, indicates the bating should be continued. Additional formic acid can be added to bring the pH to 7. The used bating liquor is drained, the hide is washed for 15 minutes with a stream of 75° F. (24° C.) tap water flowing into the drum at 100 gal./min. without removing the hides from the drum and the wash water is drained.

(g) The drum is filled with 70° to 75° F. (21° to 24° C.) tap water to provide a 40 percent float, 2 percent NaCl (or an equivalent amount of brine) is added along with 1 percent sodium formate and 0.1 percent phenoxyphenol biocide. The drum is operated for 15 minutes and the liquor is then checked to verify that it has a salimeter value of 10 to 12. If the value measures too low it is brought up by the addition of more sodium chloride. Dilute formic acid is now added to bring the pH of the liquor to about 4. The drum is then operated for 30 minutes and the liquor then adjusted to a pH between 4.8 and 5.3, if needed.

(h) The pretanning agent solution of Example I is now added after diluting with 2½ times its weight of 80° F. (27° C.) tap water. The level of the pretanning solution of Example I is used at an active amount of about 3 percent of the white weight (limed weight on hairing). The addition of the pretanning mixture is made in two equal portions, the drum is operated 15 minutes between halves.

(i) The drum is operated for an additional 45 minutes and there is then added 1 percent of an emulsified synthetic fat-liquor oil that is stable in the presence of acid electrolyte after the oil is diluted with 3 times its weight of 120° F. (49° C.) tap water. The drum is then operated for an additional hour and the liquor should then have a pH of about 5.0 to about 5.3.

(j) ½ percent formic acid pre-diluted with 10 times its weight of 80° F. (27° C.) tap water is now added. If the pH is above 5.3, more formic acid is added to reduce the pH below 5.3. The drum is run for ½ hour and the pH at that point is about 4 to 4.2. If the pH is higher than 4.2 it is brought down to 4 with additional formic acid and the drum is operated again for 15 minutes.

(k) Small samples are cut from the hides and their shrinkage temperature determined. It should be about 170° F. (77° C.), and if necessary it can be raised by keeping the hides in the tanning liquor for another hour preferably with the drum operated. More acid can be added to hold the pH at about 4 during the treatment.

(l) The drum is drained and the pretanned hides wrung, sorted, split and shaved. The grains are then ready for the main tanning operations.

(m) The grains are loaded into a drum which is then filled to 80 percent float with spent chrome liquor. The drum is operated for 15 minutes, then ½ percent formic acid pre-diluted with 10 times its weight of water is added and the drum operated for 30 minutes more. The weight of the formic acid is based on the weight of loaded grains.

(n) Dilute sulfuric acid is now added to bring the pH down to about 4, the drum operated for 15 minutes, additional sulfuric acid added to bring the pH to about 3.0 to 3.6 and the drum now operated for 45 minutes and then rested for another hour. The basic chromium sulfate is added to bring the $Cr_2O_3$ equivalent to about 2.0 percent of the grains. The drum is operated for an additional hour.

(o) The liquor is partially neutralized by the gradual addition of 1½ percent sodium bicarbonate and ½ percent sodium sulfite over 30 minutes. The drum is then run 3 more hours. At this point the pH should be greater than 3.8 and the temperature at about 110° F. (43° C.). Samples of the product do not shrink after boiling in water for 2 minutes. The product can now be washed, dyed and fat-liquored, with or without a retaining operation, to yield a high quality leather.

EXAMPLE III

The process of Example II is repeated with the following changes:

1. Light cow hides are substituted for the steer hides.
2. The bating temperature is 85° F. (30° C.), the bating salt entirely ammonium chloride, and step (d) is lengthened to 1¼ hours.
3. The synthetic fat-liquor oil is omitted from the tanning liquor from which the tanning agent mixture is the pretanning liquor of Example I.
4. The pH of the tanning liquor is adjusted to 4.5, at the start of the tanning and step (g) is lengthened to 2¼ hours.

The pretanned product of this example has a shrinkage temperature of about 75° C., but after the chrome tanning, a good quality leather results.

EXAMPLE IV

Example III is repeated, but before the pretanning there is dissolved in the pretanning liquor basic chromium sulfate in an amount that contributes 0.2 percent $Cr_2O_3$ equivalent on the weight of the hides. The pretanned product now has a shrinkage temperature over 80° C. and the spent pretanning liquor a chromium content less than 0.002 percent.

EXAMPLE V

The sequence of Example IV is repeated but this time the 0.2 percent of basic chromium oxide or spent tanning liquor is added to the pretanning liquor at step (k) to lightly color the hide to facilitate sorting. The shrinkage temperature of the pretanned hides is again over 80° C. but the spent pretanning liquor contains 0.003 percent chromium.

EXAMPLES VI–VIII

Example I was repeated except that methanol and ethanol were substituted on an equimolar basis for isopropanol as the monoalcohol. N-butanol was substituted on 0.5 molar basis. The pretanning compositions of Examples I and VI through VIII were tested for stability and used to pretan hides in accordance with Example II.

The results of the testing are reported in Table 1.

TABLE 1

| Example No. | Alcohol | Precipitation after aging at 120° F. for one week | Hide Shrink Temperature |
|---|---|---|---|
| I | isopropanol | none | 172–175 |
| VI | methanol | slight | 172–175 |
| VII | ethanol | none | 172–175 |
| VIII | n-butanol* | turbid | 162–165 |

*The n-butanol was reacted at 0.5 equivalent based on equivalents of secondary amine.

A tanning composition in accordance with Example I without the alcohol reactant showed massive precipitation after one week at 120° F. and at ambient temperature after one week.

As is demonstrated by the data in Table 1, the reaction products with alcohol etherification demonstrate increased stability over the reaction products without alcohol while maintaining good hide shrink temperature.

In accordance with the present invention the tanning agents previously described are effective as tanning agents at a level as low as 2 to 2½ percent by weight of the hides being tanned. Moreover, for most purposes the tanning liquor can also contain a small amount about 1/50 percent to about 1/5 percent by weight of the $Cr_2O_3$ equivalent, such as is present in spent chromium tanning liquors. This small amount does not significantly change the results obtained, yet the hides will absorb most if not all of such extra chromium compounds and leave the used pretanning liquor with a chromium content low enough to meet environmental standards for discharge into sewers.

A particularly important feature of the present invention is that the tanning operation following the pretanning requires less tanning agent. When the subsequent tanning is a chrome tanning, only about 1¼ percent of $Cr_2O_3$ equivalent is needed based on the weight of the hides. Very good chrome-tanned leathers are provided in this way, yet the total amount of chromium compounds required is quite small.

Tanning agents other than chromium compounds can be used to supplement the tanning of the hides after tanning with the compounds of the present invention. Thus, vegetable tanning can be used after the tanning to make shoe sole leather. Also, the subsequent tanning can be with the same type of mixture used for pretanning to produce a leather for a particular purpose.

Other ingredients known to those skilled in the art may be used in conjunction with the agents of the invention. For example, zirconium compounds, phenolic syntans, resins based on urea, and the like.

In accordance with the present invention the tanning composition of the invention may be used in conventional tanning processes. Thus, the order of processing may be the following:

1. Dehair and lime.
2. Bate.
3. Pickle.
4. Apply the tanning composition of the invention.
5. Chrome tan.
6. Split and shave.

Alternatively, the sequence may be:

1. Dehair and lime.
2. Split in the lime.
3. Bate.
4. Pickle.
5. Apply the tanning composition of the invention.
6. Chrome tan.
7. Shave to weight.

The steps above are those which are described in the examples. One particular advantage of the alternative processes is that the amount of chrome in the chrome tanning step can be reduced as much as 30 to 40 percent with a resultant reduction in the exhausted chrome liquor.

Although the invention has been described with respect to particular compositions and particular methods, it is not to be limited only so far as is set forth in the accompanying claims.

I claim:

1. A leather tanning composition comprising a sufficient amount of the reaction product of:

(a) a polyaldehydic compound;
(b) a secondary amine; and
(c) an alcohol, to increase the shrinkage temperature of a hide.

2. The composition of claim 1 wherein said polyaldehydic compound is a dialdehyde.

3. The composition of claim 2 wherein said dialdehyde is represented by the structural formula:

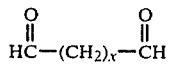

wherein x is 0 to 4.

4. The composition of claim 3 wherein said dialdehyde is glutaraldehyde.

5. The composition of claim 1 wherein said secondary amine is represented by the structural formula:

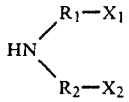

wherein $R_1$ and $R_2$ are alkylene and may be the same or different and $X_1$ and $X_2$ are hydrogen or OH and may be the same or different, and $R_1$ and $R_2$ may be covalently bonded.

6. The composition of claim 1 wherein said secondary amine is water soluble.

7. The composition of claim 6 wherein said secondary amine is an alkanol amine.

8. The composition of claim 7 wherein said secondary amine is diethanol amine.

9. The composition of claim 7 wherein said secondary amine is methyl ethanol amine.

10. The composition of claim 1 wherein said alcohol has 1 to 4 carbon atoms.

11. A composition comprising a compound represented by the structural formula:

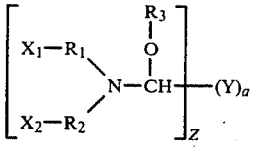

wherein Z is greater than 1, Y is a polyvalent hydrocarbon residue, $R_1$ and $R_2$ are alkylene and may be the same or different and $X_1$ and $X_2$ are hydrogen or OH and may be the same or different, "a" is equal to 0 or 1, and $R_3$ is an alkyl radical or hydrogen; a sufficient amount of $R_3$ is alkyl to impart stability to said composition.

12. The composition of claim 11 wherein Z is equal to 2.

13. The composition of claim 11 wherein Y is alkylene and has up to 4 carbon atoms.

14. The composition of claim 11 wherein $R_1$ and $R_2$ have 2 to 4 carbon atoms.

15. The composition of claim 11 wherein $X_1$ and $X_2$ are OH.

16. The composition of claim 11 wherein said compound is represented by the structural formula:

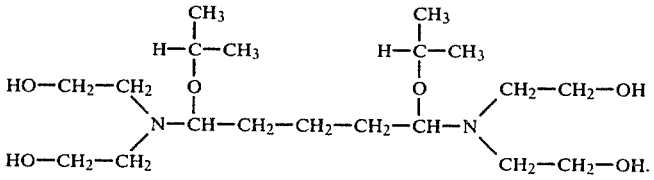

17. The composition of claim 11 wherein said compound is water soluble.

18. In the method of manufacturing leather from a hide including tanning, the improvement wherein:

said tanning is provided by a tanning composition which comprises the reaction product of:

(a) a polyaldehydic compound;

(b) a secondary amine; and (c) an alcohol at a level sufficient to increase the shrinkage temperature of a hide.

19. The method of claim 18 wherein said dialdehyde is represented by the structural formula:

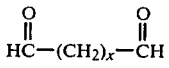

wherein x is 0 to 4.

20. The method of claim 19 wherein said dialdehyde is glutaraldehyde.

21. The method of claim 18 wherein said secondary amine is represented by the structural formula:

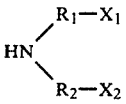

wherein $R_1$ and $R_2$ are alkylene and may be the same or different and can be covalently bonded to each other and $X_1$ and $X_2$ are hydrogen or OH and may be the same or different.

22. The method of claim 18 wherein said tan is used at a level of 2 percent by weight or greater based on the weight of the hide.

23. The method of claim 18 wherein said alcohol has 1 to 4 carbon atoms.

24. In the process of preparing leather by pretanning a hide with an essentially chromium free pretanning composition until it has a shrinkage temperature of between about 70° and 85° C. and then completing the tanning with a composition different from the pretanning composition, the improvement according to which the essentially chromium free tanning composition comprises the reaction product of:

(a) a polyaldehydic compound;

(b) a secondary amine; and (c) an alcohol.

25. The process of claim 24 in which the second tanning step is with a chrome tanning composition.

26. The process of claim 24 in which the chrome tanning is with an amount of $Cr_2O_3$ equivalent corresponding to not more than 1.4 percent by weight of the hide.

27. A composition comprised of the reaction product of:

(a) a polyaldehydic compound;

(b) a secondary amine; and (c) an alcohol.

28. The composition of claim 27 wherein said polyaldehydic compound is a dialdehyde.

29. The composition of claim 28 wherein said dialdehyde is represented by the structural formula:

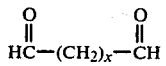

wherein x is 0 to 4.

30. The composition of claim 29 wherein said dialdehyde is glutaraldehyde.

31. The composition of claim 27 wherein said secondary amine is represented by the structural formula:

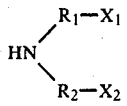

wherein $R_1$ and $R_2$ are alkylene and may be the same or different and $X_1$ and $X_2$ are hydrogen or OH and may be the same or different and $R_1$ and $R_2$ may be covalently bonded to each other.

32. The composition of claim 27 wherein said secondary amine is water soluble.

33. The composition of claim 32 wherein said secondary amine is an alkanol amine.

34. The composition of claim 33 wherein said alkanol amine is diethanol amine.

35. The composition of claim 33 wherein said alkanol amine is methyl ethanol amine.

36. The composition of claim 27 wherein said alkanol is a monohydric alcohol.

37. The composition of claim 36 wherein said monohydric alcohol has 1 to 4 carbon atoms.

38. The composition of claim 37 wherein said monohydric alcohol is isopropanol.

39. The composition of claim 10 wherein said alcohol is isopropanol.

40. The method of claim 18 wherein said alcohol is isopropanol.

41. The method of claim 18 wherein said polyaldehydic compound is a dialdehyde.

42. The composition of claims 1, 11 or 27 including a chrome tanning agent.

43. The composition of claims 1, 11 or 27 which is aqueous and has a pH of less than 7.

* * * * *

UNITED STATES PATENT AND TRADEMARK OFFICE

CERTIFICATE OF CORRECTION

PATENT NO. : 4,270,912

DATED : June 2 1981

INVENTOR(S) : William C. Prentiss

It is certified that error appears in the above-identified patent and that said Letters Patent are hereby corrected as shown below:

Column 4 Line 21 "previously" should read --preferably--.

Column 9 Line 25 After "equivalent" insert --based--.

Signed and Sealed this

*Fourth* Day of *August 1981*

[SEAL]

*Attest:*

GERALD J. MOSSINGHOFF

*Attesting Officer*

*Commissioner of Patents and Trademarks*